US011647846B2

(12) United States Patent
Tuckey et al.

(10) Patent No.: US 11,647,846 B2
(45) Date of Patent: May 16, 2023

(54) BASSINET

(71) Applicant: Wonderland Switzerland AG, Steinhausen (CH)

(72) Inventors: Peter R. Tuckey, Leola, PA (US); Lance J. Clemmer, Mohnton, PA (US); Andrew J. Taylor, Mohnton, PA (US)

(73) Assignee: WONDERLAND SWITZERLAND AG, Steinhausen (CH)

( * ) Notice: Subject to any disclaimer, the term of this patent is extended or adjusted under 35 U.S.C. 154(b) by 305 days.

(21) Appl. No.: 16/734,069

(22) Filed: Jan. 3, 2020

(65) Prior Publication Data

US 2020/0214470 A1 Jul. 9, 2020

Related U.S. Application Data

(60) Provisional application No. 62/789,671, filed on Jan. 8, 2019, provisional application No. 62/792,102, filed on Jan. 14, 2019.

(51) Int. Cl.
*A47D 9/00* (2006.01)
*A47D 7/04* (2006.01)

(52) U.S. Cl.
CPC ..... *A47D 9/005* (2013.01); *A47D 7/04* (2013.01)

(58) Field of Classification Search
CPC . A47D 9/005; A47D 9/00; A47D 9/04; A47D 7/04; A47D 13/06; A47D 13/061; A47D 13/066; A47D 13/068
See application file for complete search history.

(56) References Cited

U.S. PATENT DOCUMENTS 3,146,736 A * 9/1964 Robert ..... A47D 9/005 5/98.1
4,635,305 A * 1/1987 Wyss ..... A47D 7/002 5/99.1

(Continued)

FOREIGN PATENT DOCUMENTS

CN 102342693 B 12/2013
CN 203633849 U 6/2014

(Continued)

OTHER PUBLICATIONS

Plate, (n.d.) American Heritage® Dictionary of the English Language, Fifth Edition. (2011). Retrieved Dec. 15, 2022 from https://www.thefreedictionary.com/plate (Year: 2011).*

(Continued)

*Primary Examiner* — Eric J Kurilla
*Assistant Examiner* — Amanda L Bailey
(74) *Attorney, Agent, or Firm* — Cantor Colburn LLP

(57) ABSTRACT

A bassinet includes a frame unit, two legs pivotally connected to the frame unit, a bottom plate disposed between the legs, and a lower limiting mechanism disposed on at least one of the legs. The bottom plate is detachably connected to the legs via the lower limiting mechanism. Another bassinet includes the frame unit, four of the legs pivotally connected to the frame unit and disposed angularly spaced apart from each other, an upper limiting mechanism disposed on at least one of the frame unit and the legs for limiting pivotal movement of the legs away from each other, and the bottom plate detachably connected to the legs to exert forces pushing the legs away from each other.

11 Claims, 15 Drawing Sheets

(56) References Cited

U.S. PATENT DOCUMENTS

| | | | | |
|---|---|---|---|---|
| 5,040,254 | A * | 8/1991 | Frank | A47D 7/002 5/100 |
| 8,307,475 | B2 | 11/2012 | Hutchinson et al. | |
| 9,179,786 | B1 * | 11/2015 | Ransil | A47D 13/063 |
| 2003/0106149 | A1 * | 6/2003 | Hsia | A47D 9/005 5/99.1 |
| 2006/0225204 | A1 * | 10/2006 | Bretschger | A47D 7/04 5/93.1 |
| 2006/0225205 | A1 * | 10/2006 | Troutman | F16B 2/22 24/72.5 |
| 2006/0253978 | A1 * | 11/2006 | Paesang | A47D 7/04 5/99.1 |
| 2008/0271243 | A1 * | 11/2008 | Burkholder | A47D 9/00 5/93.2 |
| 2010/0162484 | A1 * | 7/2010 | Thomas | A47D 5/00 5/93.1 |
| 2012/0096646 | A1 * | 4/2012 | Barron | A47D 1/10 5/655 |
| 2012/0235103 | A1 * | 9/2012 | Greger | A47D 9/00 256/25 |
| 2015/0047122 | A1 * | 2/2015 | Ingram | A47D 13/063 5/98.1 |
| 2015/0216322 | A1 * | 8/2015 | Longenecker | A47D 9/005 5/99.1 |
| 2017/0196373 | A1 * | 7/2017 | Sclare | A47D 13/063 |
| 2019/0335917 | A1 * | 11/2019 | Taylor | A47D 13/063 |

FOREIGN PATENT DOCUMENTS

| | | | | |
|---|---|---|---|---|
| CN | 205548140 | U | 9/2016 | |
| CN | 106490883 | A | 3/2017 | |
| CN | 107224150 | A | 10/2017 | |
| DE | 102008054185 | B4 | 6/2012 | |
| EP | 3199065 | A1 | 8/2017 | |
| GB | 2575340 | A | 1/2020 | |
| WO | 2010/059114 | A1 | 5/2010 | |
| WO | WO-2010059114 | A1 * | 5/2010 | A47D 9/005 |

OTHER PUBLICATIONS

Search Report issued to U.K. counterpart application No. GB1919448 9 by the U.K. Intellectual Property Office dated Jun. 26, 2020 (3 pages).

Translation of German Office Action for Application No. 102020200033.6 dated Jul. 10, 2022, 5 pages.

China Office Action and Search Report for China Application No. 202010003768X, dated Feb. 1, 2023, with English Translation, 11 pages.

* cited by examiner

BASSINET

CROSS-REFERENCE TO RELATED APPLICATION

This application claims priority of U.S. Provisional Application No. 62/789,671, filed on Jan. 8, 2019, and U.S. Provisional Application No. 62/792,102, filed on Jan. 14, 2019.

FIELD

The disclosure relates to a bassinet, and more particularly to a bassinet that is convertible to a collapsed state.

BACKGROUND

With growing concern about the care and safety of infants, many kinds of bassinets have been developed for the market. A bassinet is often cumbersome to move about, and disassembly of the same might be time-consuming or even difficult for a caregiver. Moreover, a bassinet with different operation modes, such as being able to operate on a standalone basis and also being able to be attached to a playard, is of particular interest to many caregivers. In addition, the structural integrity of the bassinet is one of the most important concerns to the caregiver for the safety of the infants and even the caregiver themselves.

SUMMARY

Therefore, an object of the disclosure is to provide a bassinet that can alleviate the drawback of the prior art.

According to one aspect of this disclosure, a bassinet is provided. The bassinet is adapted to be detachably connected to a playard, and includes a frame unit, two legs a bottom plate and a lower limiting mechanism. The legs are pivotally connected to the frame unit. The bottom plate is disposed between the legs. The lower limiting mechanism is disposed on at least one of the legs. The bottom plate is detachably connected to the legs via the lower limiting mechanism.

According to another aspect of this disclosure, another bassinet is provided. The bassinet includes a frame unit, four legs, an upper limiting mechanism and a bottom plate.

The legs are pivotally connected to the frame unit and are disposed angularly spaced apart from each other. Each of the legs is made of an elastic material. The upper limiting mechanism is disposed on at least one of the frame unit and the legs for limiting pivotal movement of the legs away from each other. The bottom plate is detachably connected between the legs to exert forces pushing the legs away from each other. The bassinet is convertible to a collapsed state, where the bottom plate is detached from the legs and the legs are pivoted toward each other and support the bottom plate.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
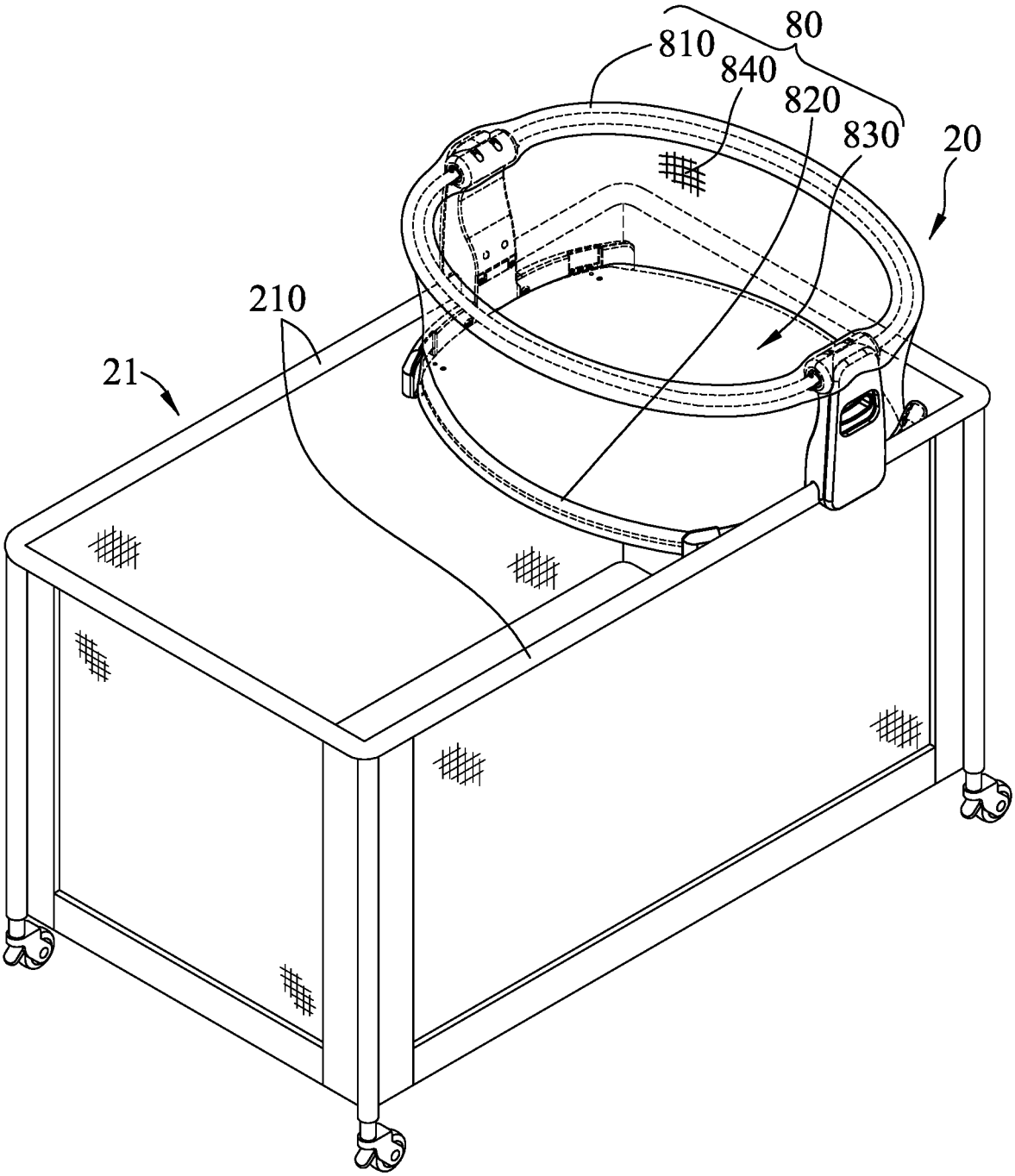
FIG. 1 is a schematic perspective view of a first embodiment of a bassinet according to the present disclosure, the bassinet being detachably connected to a playard.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
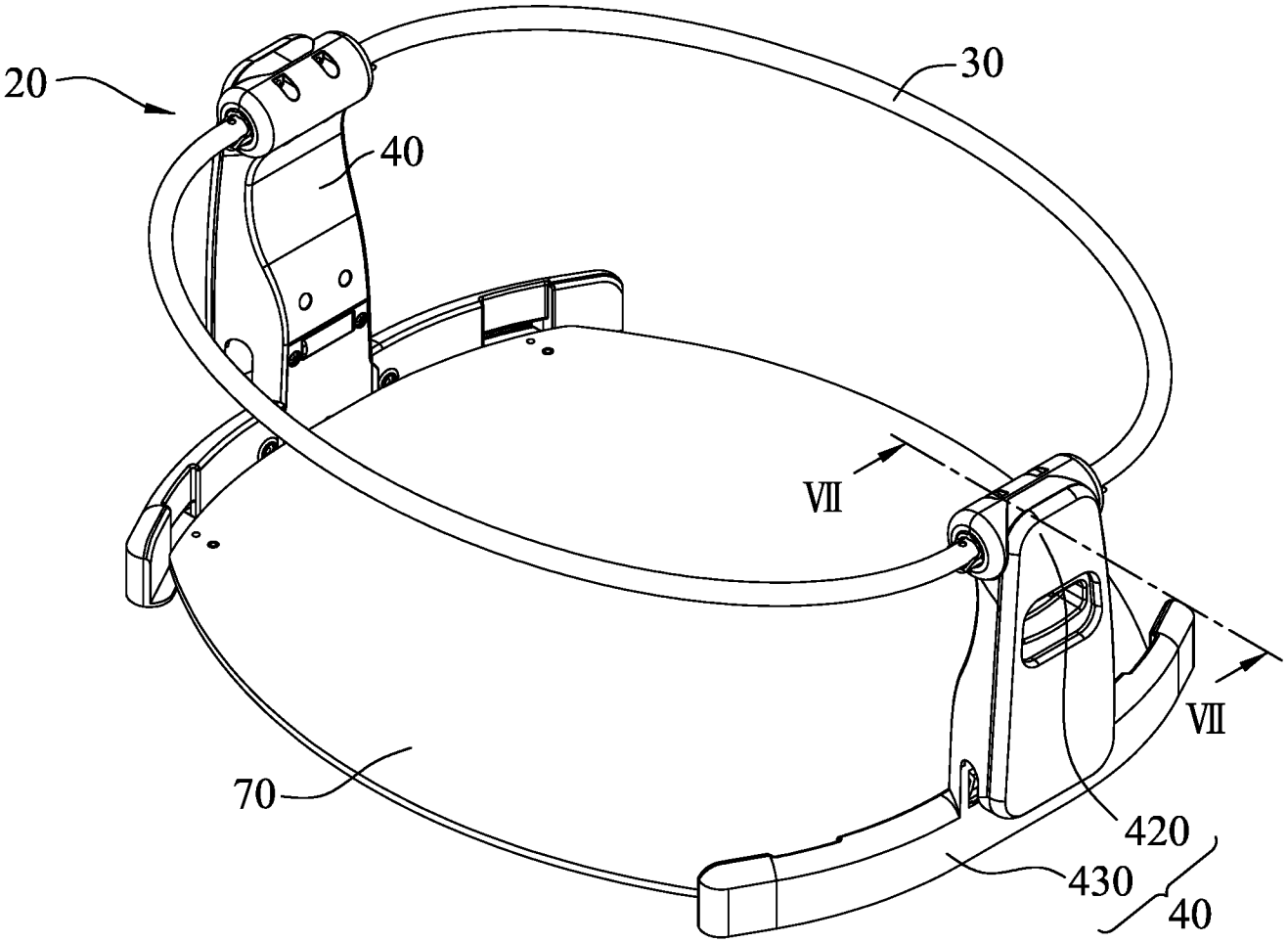
FIG. 2 is a perspective view of the first embodiment in an upright state with a bedding omitted.
Figure 3:
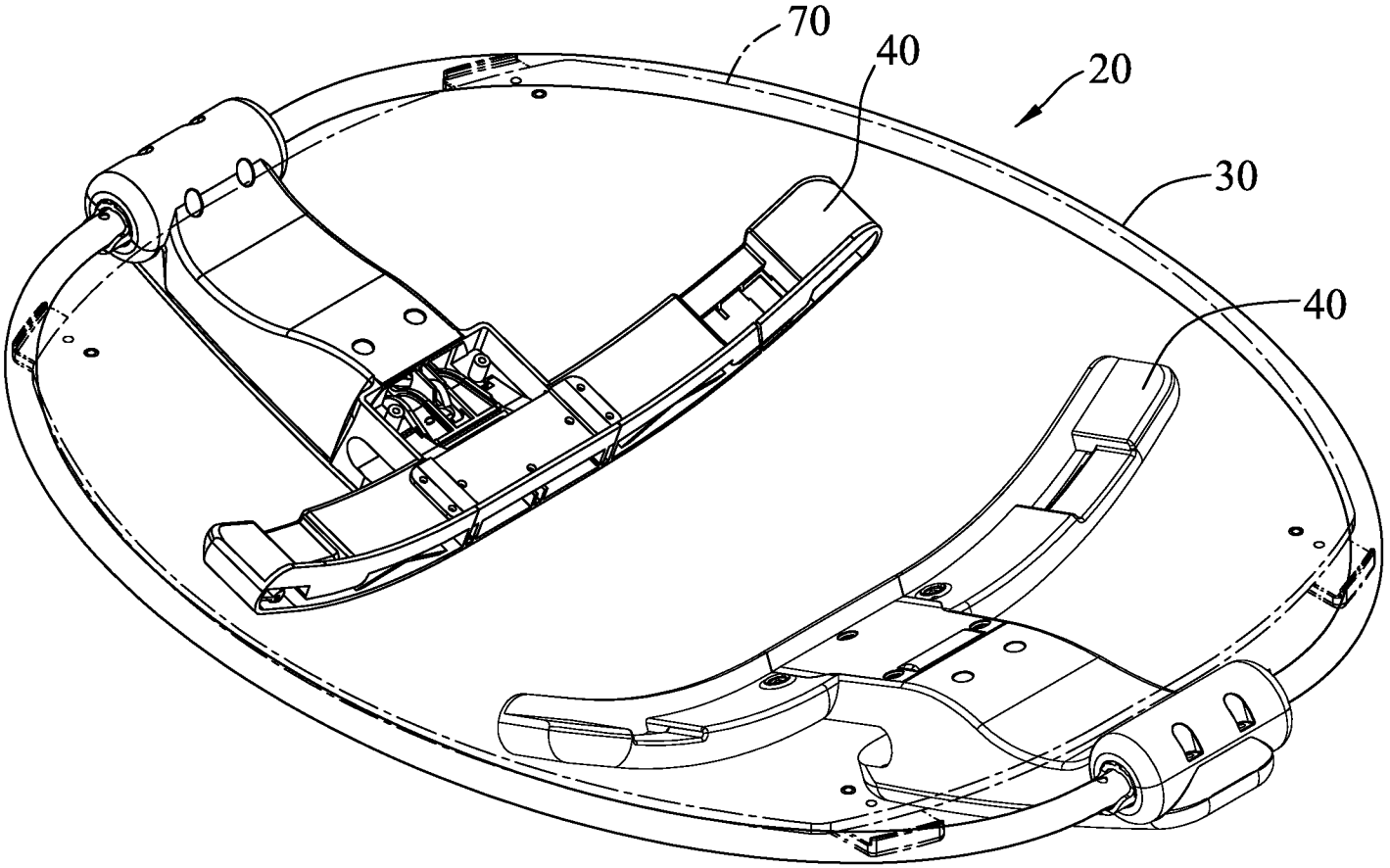
FIG. 3 is a schematic perspective view showing the first embodiment in a collapsed state.
Figure 4:
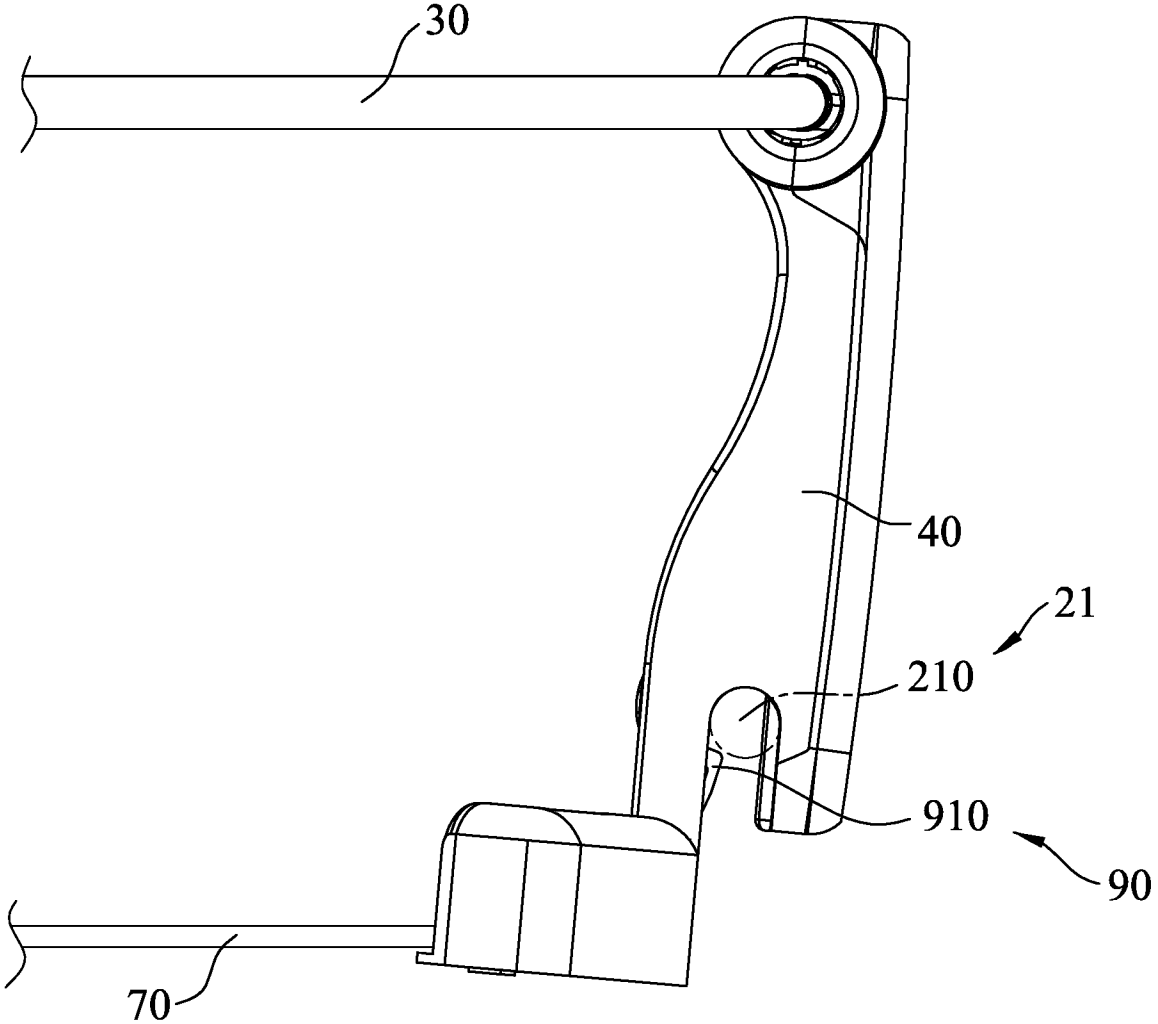
FIG. 4 is a fragmentary and schematic side view showing the first embodiment connected to a top rail of the playard.

Referring to FIGS. 1 to 3, a first embodiment of a bassinet 20 according to the present disclosure is adapted to be detachably connected to a playard 21, a playpen or other pieces of furniture in which an infant can be placed for preventing the infant from harming themselves, especially when a caregiver is away from the infant.

The bassinet 20 can be converted between an upright state (see FIGS. 1 and 2) for being connected to the playard 21 and to hold the infant, and a collapsed state (see FIG. 3) for being easily transported by the caregiver.

Referring to FIGS. 1 to 7 and 11, the bassinet 20 includes a frame unit 30, two legs 40, an upper limiting mechanism 50, a lower limiting mechanism 60, a bottom plate 70, a bedding 80 and a locking mechanism 90. In this disclosure, the bedding 80 is only shown in FIG. 1 and is omitted in the remainder of the figures to clearly illustrate the structure of the bassinet 20.

The legs 40 are pivotally connected to the frame unit 30, and are adapted to be detachably connected to a top rail 210 of the playard 21. Each of the legs 40 is made of an elastic material. The upper limiting mechanism 50 is disposed on at least one of the frame unit 30 and the legs 40 for limiting pivotal movement of the legs 40 away from each other. It should be noted that, based on practical design requirements, the upper limiting mechanism 50 may be disposed only on the frame unit 30, only on the legs 40, or on both the frame unit 30 and the legs 40. The bottom plate 70 is detachably connected between the legs 40 via the lower limiting mechanism 60 to exert forces pushing the legs 40 away from each other to keep the bassinet 20 in the upright state. The lower limiting mechanism 60 is disposed on at least one of the bottom plate 70 and the legs 40 for detachably connecting the bottom plate 70 to the legs 40. It should be noted that, based on practical design requirements, the lower limiting mechanism 60 may be disposed only on the bottom plate 70, only on the legs 40, or on both the bottom plate 70 and the legs 40. The bedding 80 covers the other components of the bassinet 20 for providing a comfortable environment for the infant, and has a first portion 810 that is at least connected to the frame unit 30 and a second portion 820 that is opposite to the first portion 810 and that is connected to the bottom plate 70. The bedding 80 defines a space 830 that is adapted for receiving the infant. Specifically, in this embodiment, each of the legs 40 has a first end 420 that is pivotally and detachably connected to the frame unit 30, and a second end 430 that is opposite to the first end 420 and that is connected detachably to the bottom plate 70. The first portion 810 of the bedding 80 is connected detachably to, and encloses the frame unit 30 and the first end 420 of each of the legs 40. The second portion 820 of the bedding 80 encloses the bottom plate 70. The bedding 80 further has a middle portion 840 that is connected between the first and second portions 810, 820, and at least a part of the middle portion 840 of the bedding 80 is light-transmissible (e.g., a soft screen net) for the infant in the space 830 to be visible from the outer side of the bassinet 20.

Figure 5:
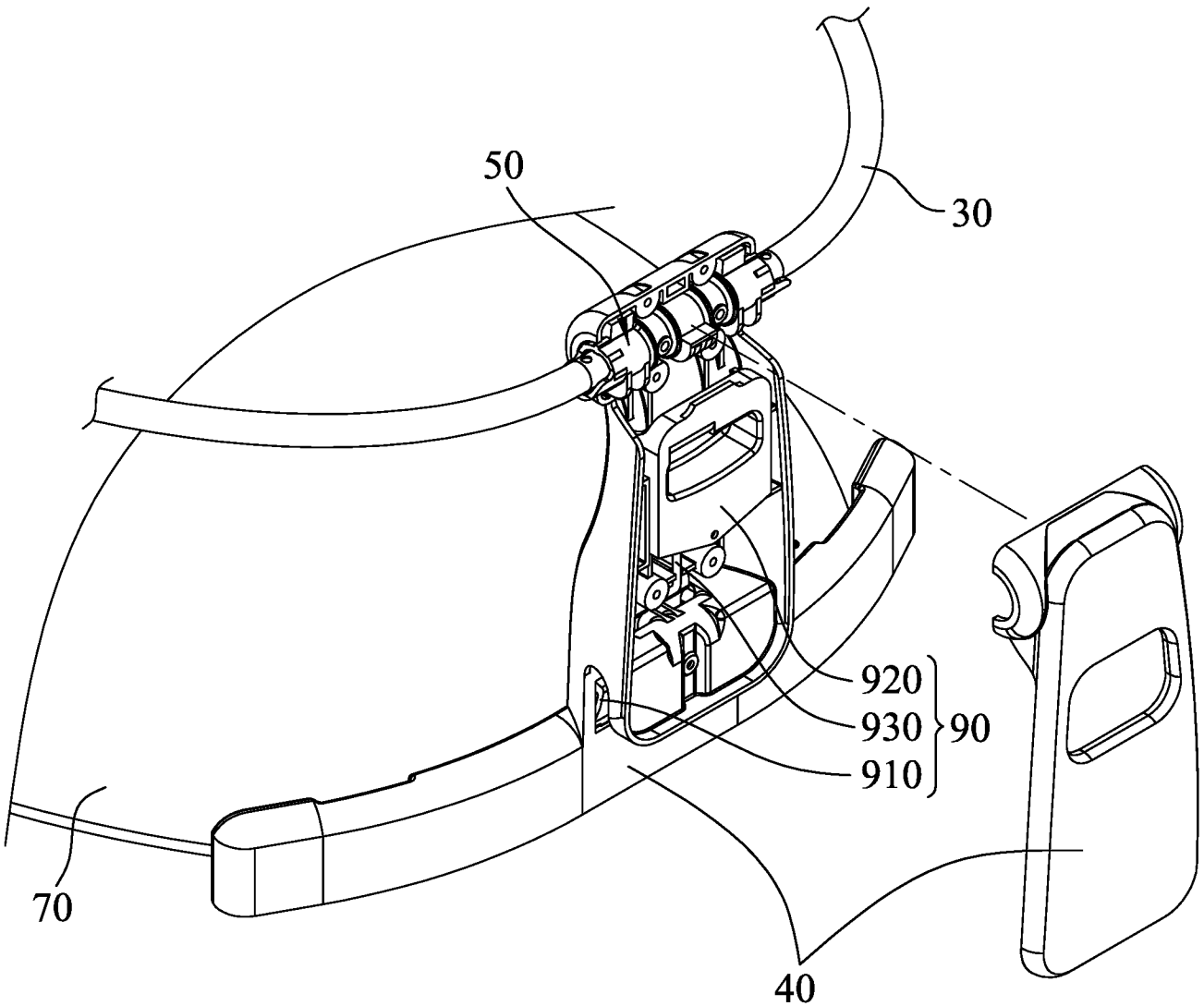
FIG. 5 is a fragmentary and partly exploded view of the first embodiment.
Figure 6:
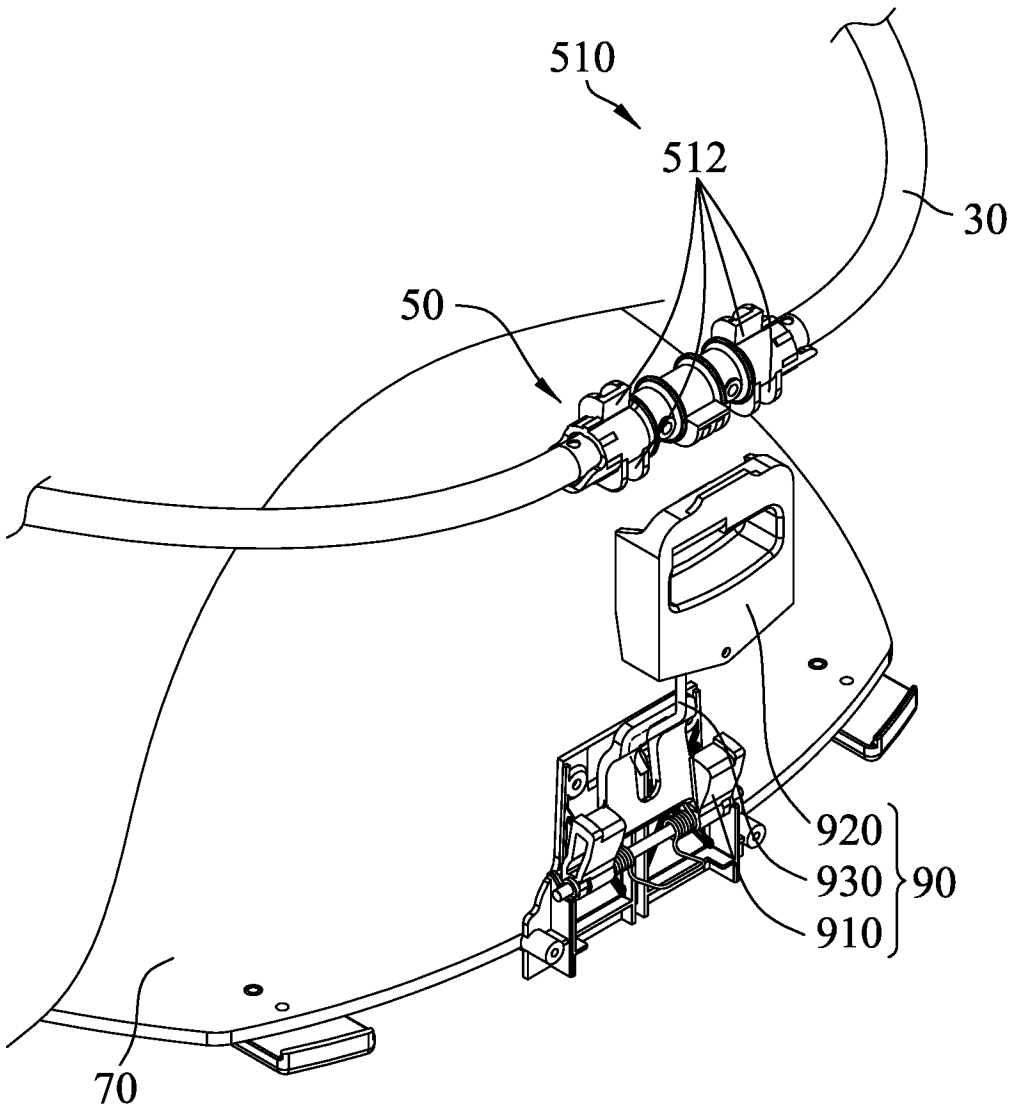
FIG. 6 is a fragmentary and partly perspective view of the first embodiment with a part of a leg of the first embodiment omitted.

The locking mechanism 90 includes two locking members 910 (only one is shown in FIGS. 5 and 6) that are respectively connected to the legs 40 and that are adapted to be engaged with the top rail 210 of the playard 21 such that the bassinet 20 is securely connected to the playard 21. In this embodiment, the locking mechanism 90 further includes two push buttons 920 (only one is shown in FIGS. 5 and 6) that are respectively connected to the legs 40, and that are respectively and operably connected to the locking members 910 through two bars 930 (only one is shown in FIGS. 5 and 6). Each of the pushbuttons 920 is partially exposed from the respective one of the legs 40, and is pushable by a user (e.g., the caregiver) to move the respective one of the locking members 910 via the respective one of the bars 930, such that the locking members 910 are disengaged from the playard 21 to allow the caregiver to remove the bassinet 20 from the playard 21.

When the bassinet 20 is detached from the playard 21, the bassinet 20 is convertible from the upright state to the collapsed state, where the bottom plate 70 is detached from the legs 40 and the legs 40 are pivoted toward each other and folded. Before the legs 40 are folded, the bottom plate 70 may be lifted and slightly tilted to pass through the frame unit 30 from underneath and then placed on the frame unit 30 and the folded legs 40. The collapsed bassinet 20 is compact and can be easily transported by the caregiver or stored within a relatively small space. It should be noted that the upper limiting mechanism 50 is provided for limiting pivotal movement of the legs 40 away from each other. However, since each of the legs 40 is made of an elastic material, the legs 40 can be forced to slightly pivot outward against the upper limiting mechanism 50 to disengage the bottom plate 70 from the legs 40. After disengagement of the bottom plate 70, the legs 40 can be pivoted toward each other. In one embodiment, each of the legs 40 may be a monolithic piece (i.e., integrally formed as one piece) made of plastic or metal. It should be noted that each of the legs 40 may be made of other elastic materials according to practical requirements, and may be made of several pieces assembled together as long as each of the legs 40 is elastic as a whole.

Figure 7:
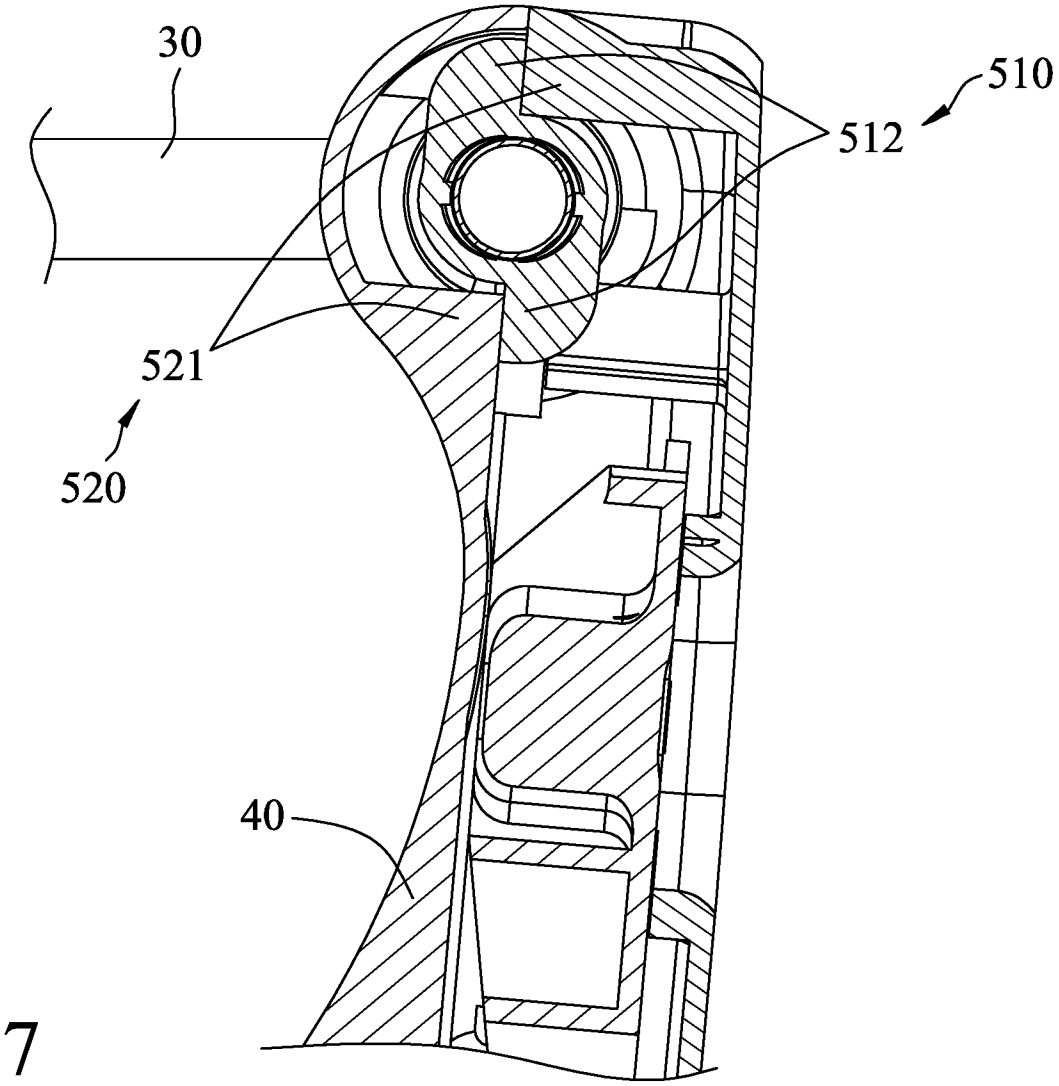
FIG. 7 is a fragmentary sectional view of the first embodiment taken along line VII-VII of FIG. 2.

The upper limiting mechanism 50 includes two first upper limiting members 510 (only one is shown in FIGS. 6 and 7) that are disposed on the frame unit 30, and two second upper limiting members 520 (only one is shown in FIG. 7) that are respectively disposed on the legs 40 in such a manner that, when the bottom plate 70 is connected between the legs 40, the first upper limiting members 510 respectively abut against the second upper limiting members 520 to limit pivotal movement of the legs 40 away from each other. In this embodiment, each of the first upper limiting members 510 includes an upper limiting block 512 that protrudes from the frame unit 30, and each of the second upper limiting members 520 includes an upper limiting wall 521 that protrudes from the respective one of the legs 40 and that abuts against the upper limiting block 512 of the respective one of the first limiting members 510 when the bottom plate 70 is connected between the legs 40. It should be noted that the number of the upper limiting blocks 512 of each of the first upper limiting members 510 may be more than one (e.g., four as shown in FIG. 6), and a corresponding number of the upper limiting walls 521 of the respective one of the second upper limiting members 520 is provided to ensure the first upper limiting members 510 cooperate with the second upper limiting members 520 to precisely and steadily limit the pivotal movement of the legs 40 when the bottom plate 70 is connected between the legs 40.

Figure 8:
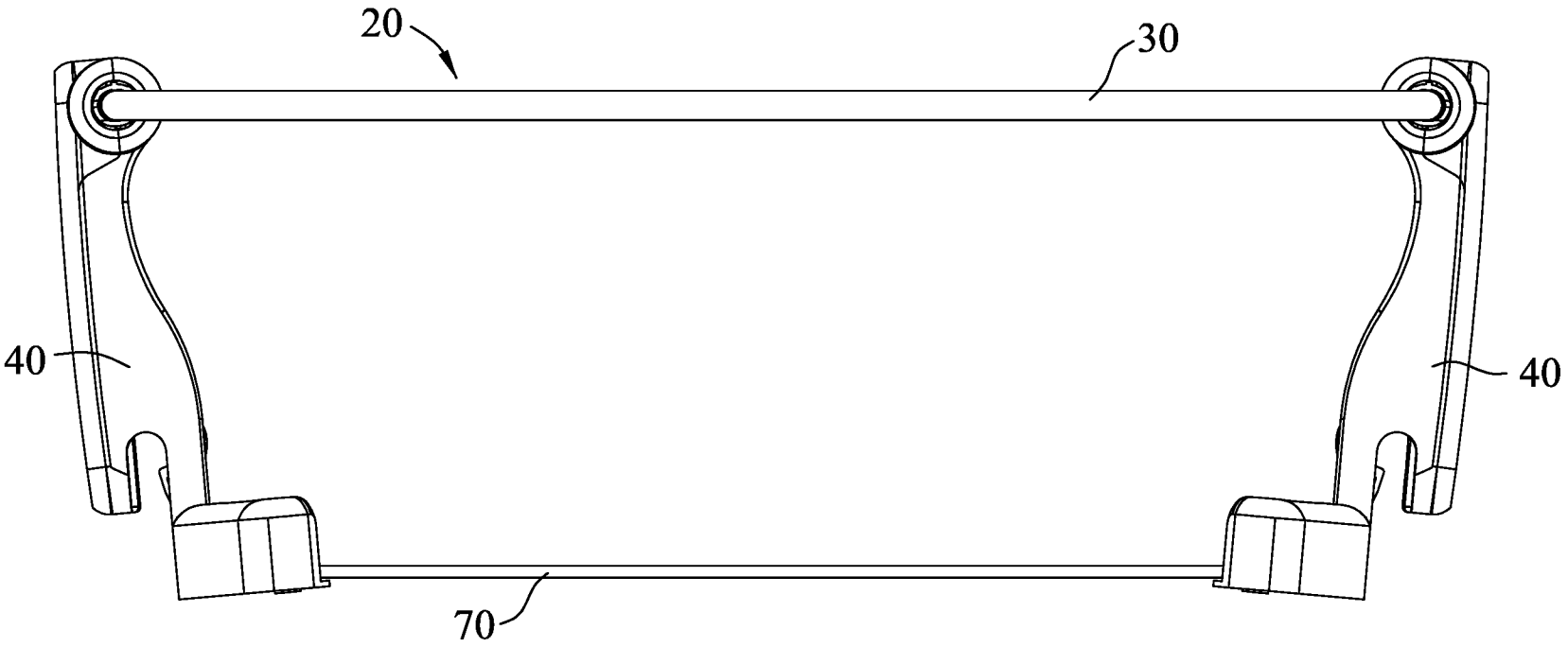
FIG. 8 is a side view of the first embodiment.

Referring further to FIG. 8, another function of the upper limiting mechanism 50 is to ensure that, when the bottom plate 70 is connected between the legs 40, each of the legs 40 is forced by the bottom plate 70 to be slightly deformed. Such configuration results in a torque load in each pair of the first and second limiting members 510, 520. Moreover, such configuration also results in the second end 430 of each of the legs 40 not being easy to separate from the bottom plate 70 when a horizontal force is applied to the bassinet 20. The abovementioned configuration imparts a robust and sturdy structure to the bassinet 20, which guards the safety of the infant and the caregiver. In one embodiment, when the bottom plate 70 is connected between the legs 40, each of the legs 40 is so positioned to extend in a direction that is inclined away from the bottom plate 70.

Figure 9:
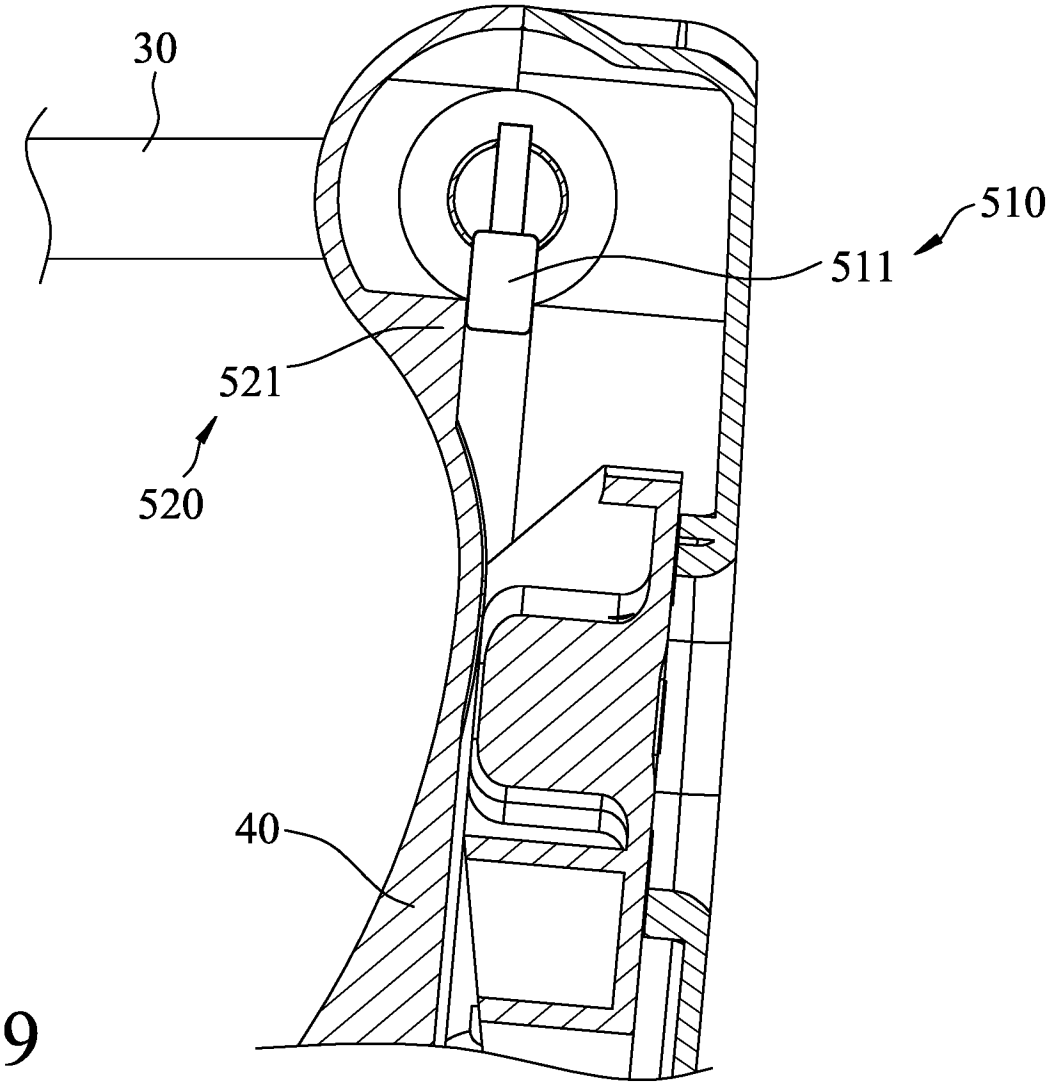
FIG. 9 is a view similar to FIG. 7, showing a fragmentary sectional view of a first variation of the first embodiment.

Referring further to FIG. 9, in a first variation of the first embodiment, each of the first upper limiting members 510 includes a pin 511 instead of the upper limiting block 512, and each of the second upper limiting members 520 includes the upper limiting wall 521 that protrudes from the respective one of the legs 40. The pin 511 of each of the first upper limiting members 510 is fixed to the frame unit 30, and when the bottom plate 70 is connected between the legs 40, the upper limiting wall 521 of each of the second upper limiting members 520 abuts against the pin 511 of the respective one of the first upper limiting members 510 to limit pivotal movement of the legs 40 away from each other. In certain embodiments, the pin 511 of each of the first upper limiting members 510 may be a rivet, and more particularly a shouldered rivet.

Figure 10:
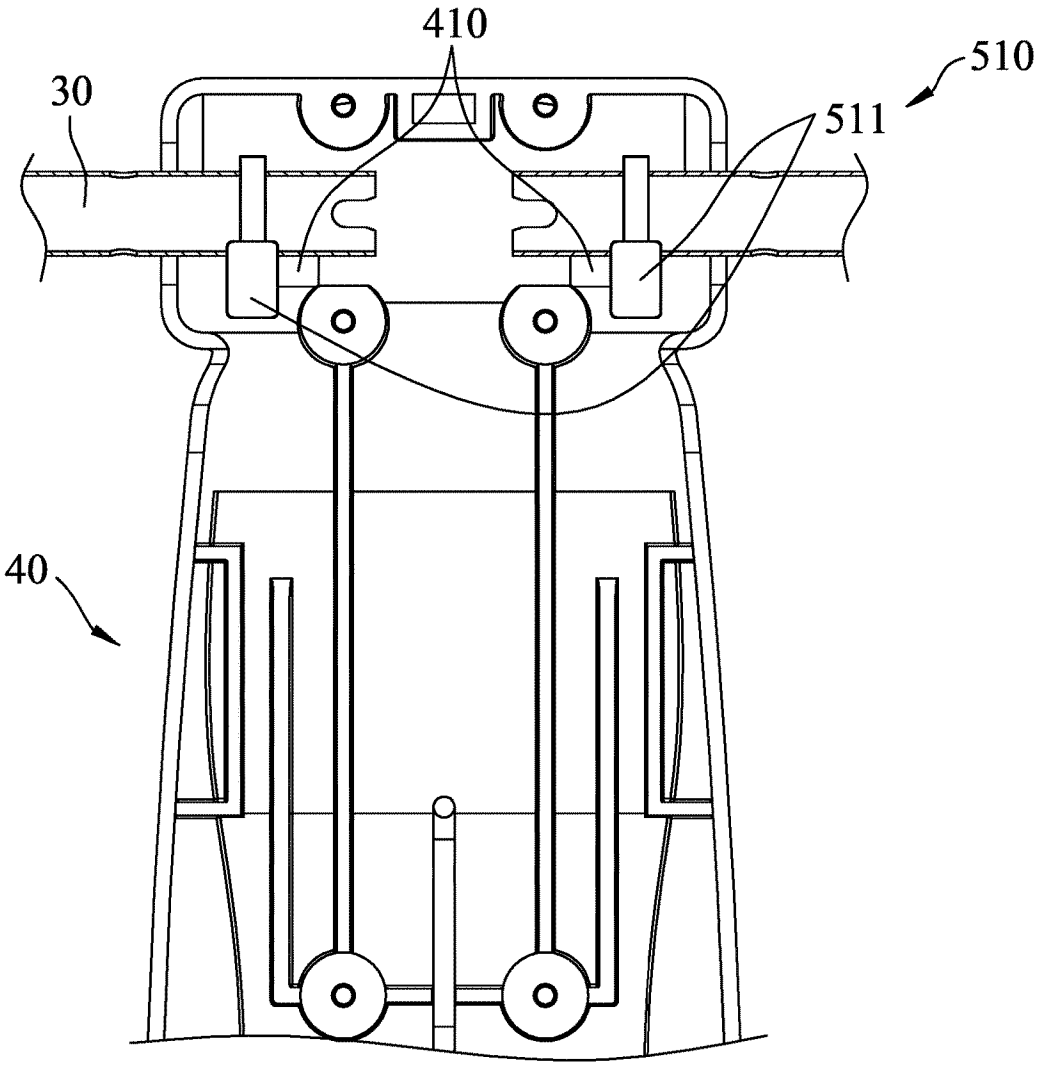
FIG. 10 is a fragmentary and partly sectional view of a second variation of the first embodiment, with a part of the leg removed to show that two pins of the second variation respective abut against two opposite sides of the leg.

Referring further to FIG. 10, in a second variation of the first embodiment, each of the first upper limiting members 510 includes two of the pins 511 that are fixed to the frame unit 30 and that respectively abut against two opposite sides 410 of the respective one of the legs 40 for preventing translational movement of the respective one of the legs 40 relative to the frame unit 30. In this variation, each of the second upper limiting members 520 may include two of the upper limiting walls 521 to respectively abut against the pins 511 of the respective one of the first upper limiting members 510 when the bottom plate 70 is connected between the legs 40 to limit pivotal movement of the legs 40 away from each other.

Figure 11:
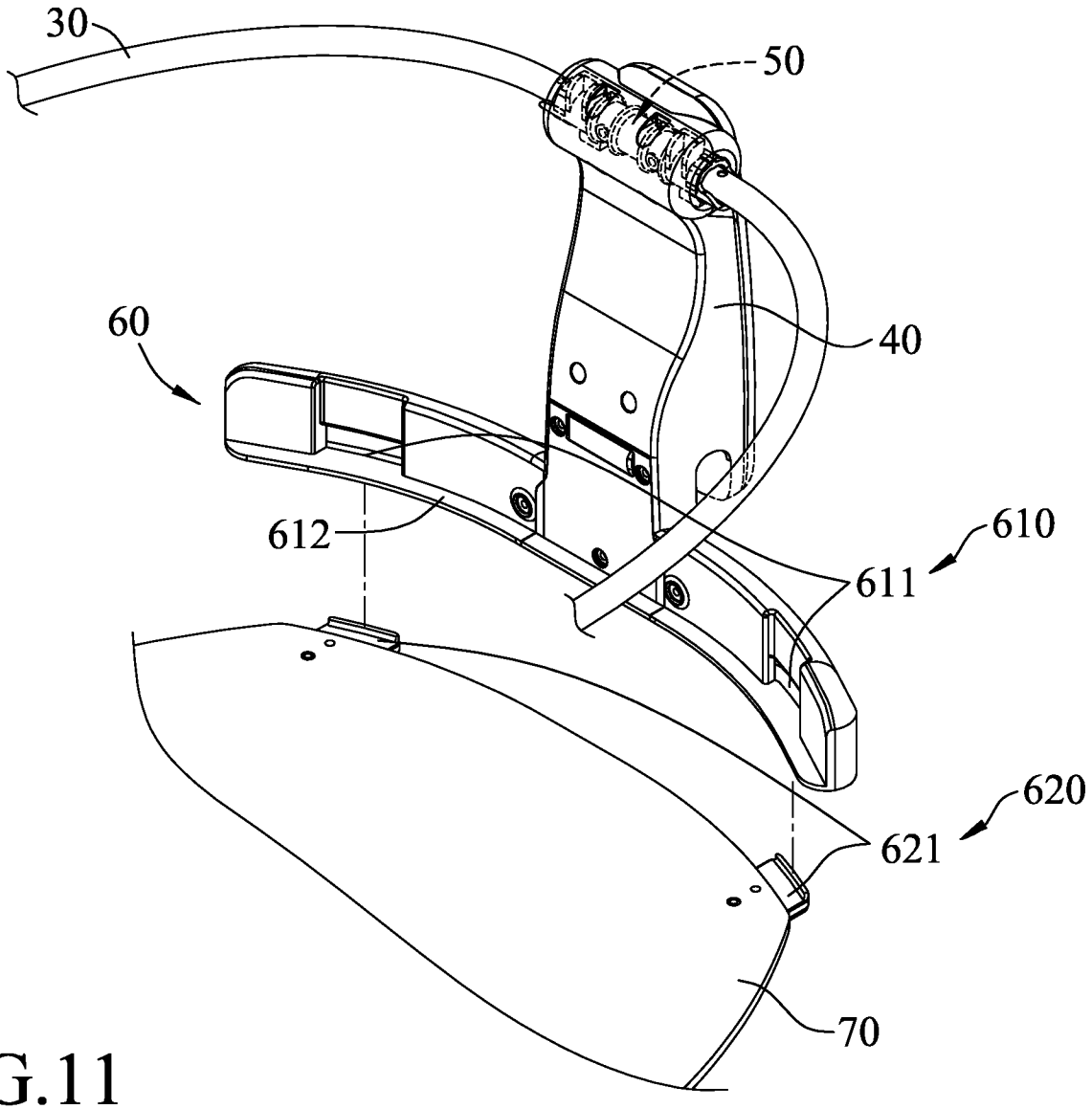
FIG. 11 is a fragmentary, perspective and partly exploded view of a third variation of the first embodiment.

In the first embodiment, the lower limiting mechanism 60 includes two first lower limiting members 610 (only one is shown in FIG. 11) that are respectively disposed on the legs 40, and two second lower limiting members 620 (only one is shown in FIG. 11) that are disposed on the bottom plate 70. The first lower limiting members 610 respectively and detachably engage the second lower limiting members 620 to connect the bottom plate 70 to the legs 40. Each of the first lower limiting members 610 is a notch 611, and each of the second lower limiting members 620 extends from the bottom plate 70 (e.g., being a protruding block 621) and detachably engages the notch 611 of a respective one of the first lower limiting members 610 to connect the bottom plate 70 to the legs 40. In this embodiment, each of the first lower limiting members 610 has two of the notches 611, and each of the second lower limiting members 620 has two of the protruding blocks 621 that respectively and detachably engage the notches 611 of the respective one of the first lower limiting members 610 to ensure a more secure connection between the bottom plate 70 and the legs 40. It should be noted that the positions of the notches 611 and the protruding blocks 621 may be interchanged. That is, the notches 611 may be provided to the bottom plate 70, and each of the protruding blocks 621 may be provided to a corresponding leg 40.

In a third variation of the first embodiment, each of the first lower limiting members 610 of the lower limiting mechanism 60 has a groove 612 that is formed in an inner side of the respective one of the legs 40 and that extends horizontally, and each of the second lower limiting members 620 of the lower limiting mechanism 60 includes a portion of peripheral edge of the bottom plate 70. When the bottom plate 70 is connected to the legs 40, the portions of peripheral edge of the bottom plate 70 are respectively received in the grooves 612 formed in the legs 70. Such configuration also ensures that the bottom plate 70 can be detachably and securely connected to the legs 40, and that the bottom plate 70 may be prevented from moving downwardly relative to the legs 40.

Figure 12:
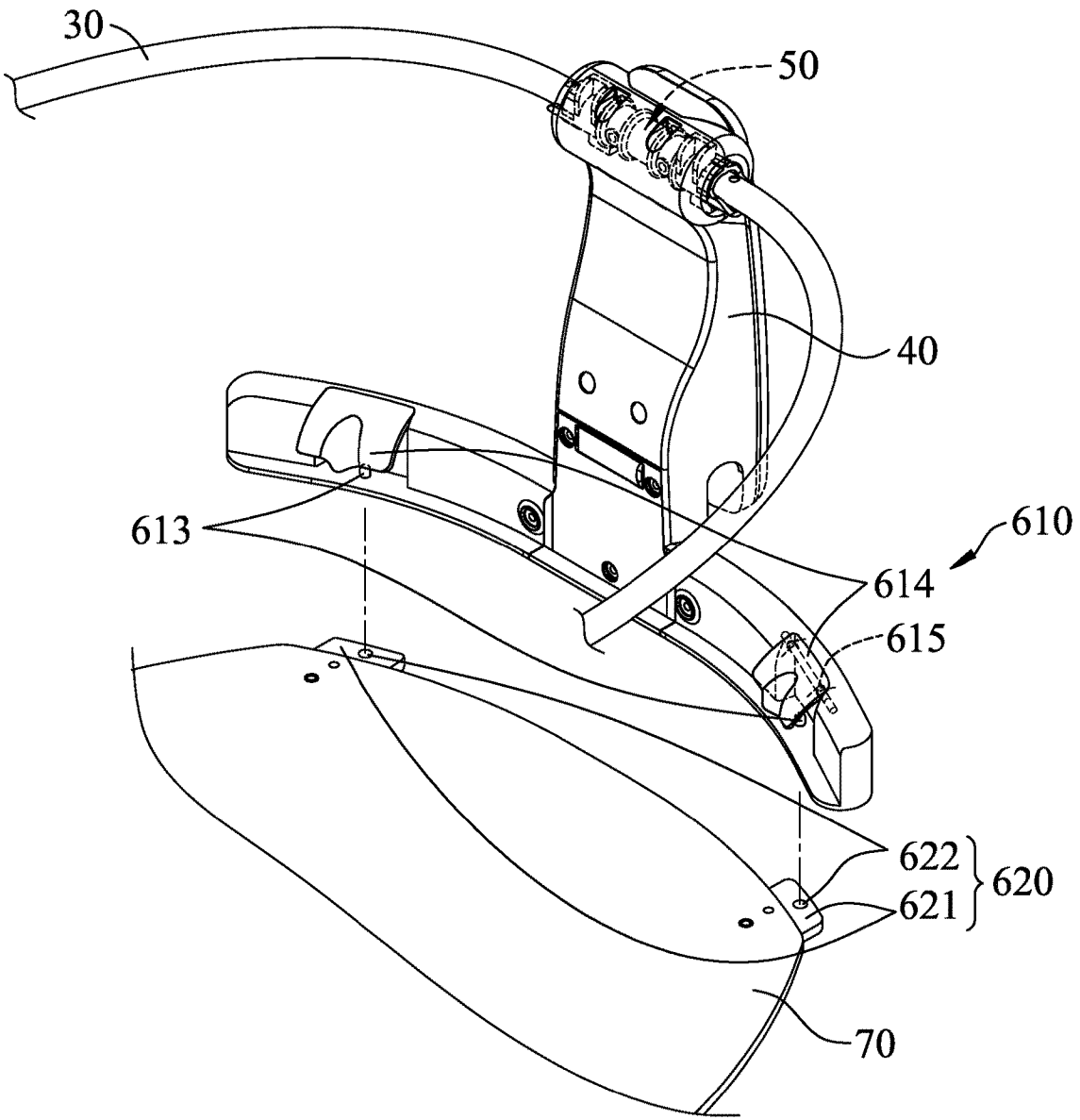
FIG. 12 is a fragmentary, perspective and partly exploded view of a fourth variation of the first embodiment.

Referring further to FIG. 12, in a fourth variation of the first embodiment, each of the second lower limiting members 620 has a engagement hole 622, and each of the first lower limiting members 610 includes a protrusion 613 that is disposed relative to the engagement hole 622 of the respective one of the second lower limiting members 620 to be detachably engaged with the engagement hole 622 of the respective one of the second lower limiting members 620, and a cover door 614 that is pivotally connected to the respective one of the legs 40 and that is resiliently biased to removably cover the protrusion 613 of the respective one of the first lower limiting members 610. Specifically, in this variation, each of first lower limiting members (610) further includes a spring element (615) (e.g., a torsion spring) that provides the cover door (614) of the respective one of the first lower limiting members 610 a rotation force toward the bottom plate (70). When converting the bassinet 20 from the upright state to the collapsed state, the cover door 614 of each of the first lower limiting members 610 is operable to uncover the protrusion 613 of the respective one of the first lower limiting members 610 against the rotation force, such that the second lower limiting members 620 are respectively disengageable from the first lower limiting members 610. The cover doors 614 of the first lower limiting members 610 cooperate with the engagement holes 622 of the second lower limiting members 620 and the protrusions 613 of the first lower limiting members 610 to ensure that the bottom plate 70 is secured to the legs 40 when the bassinet 20 is in the upright state. In this variation, each of the first lower limiting members 610 includes two of the protrusions 613 and two of the cover doors 614, and each of the second lower limiting members 620 thus includes two of the engagement holes 622 to be respectively engaged with the protrusions 613 of the respective one of the first lower limiting members 610.

Figure 13:
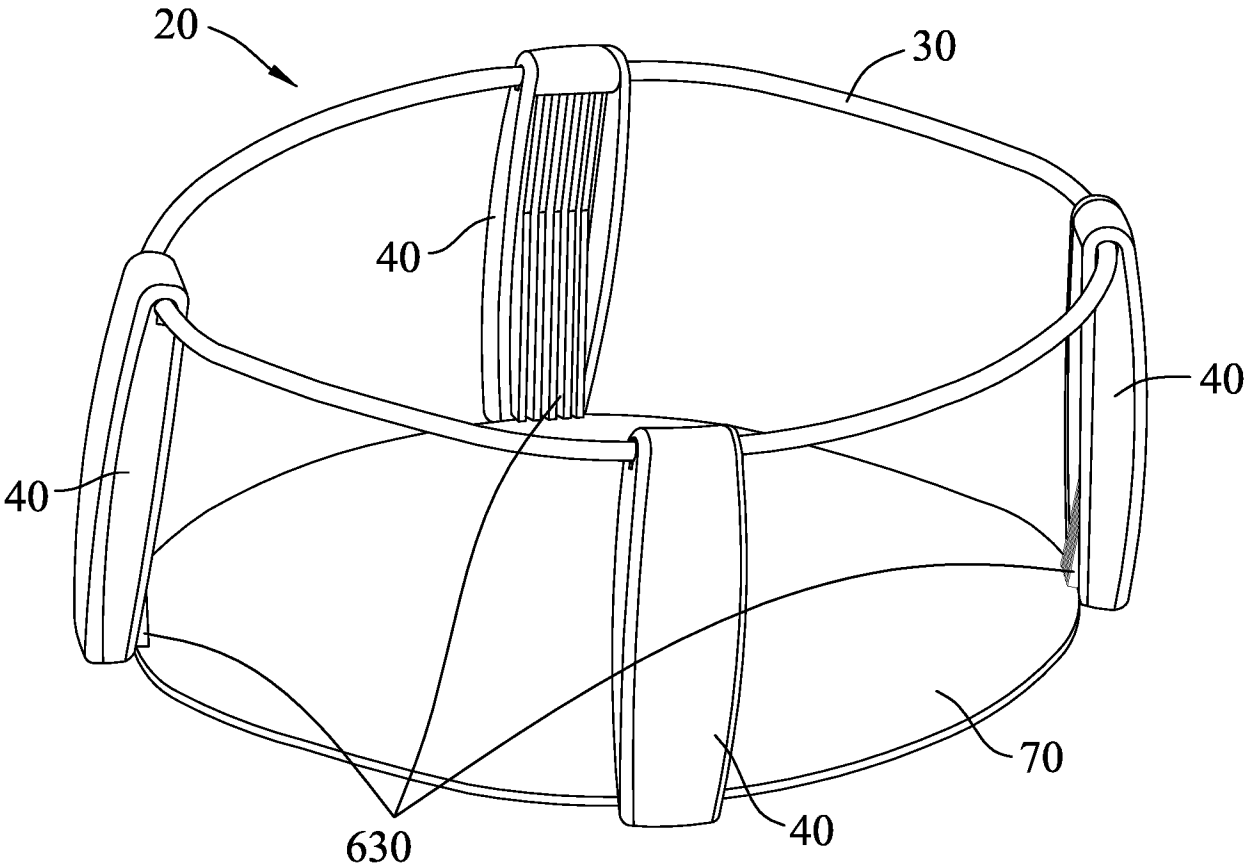
FIG. 13 is a perspective view of a second embodiment of the bassinet according to the present disclosure, which is in the upright state.
Figure 14:
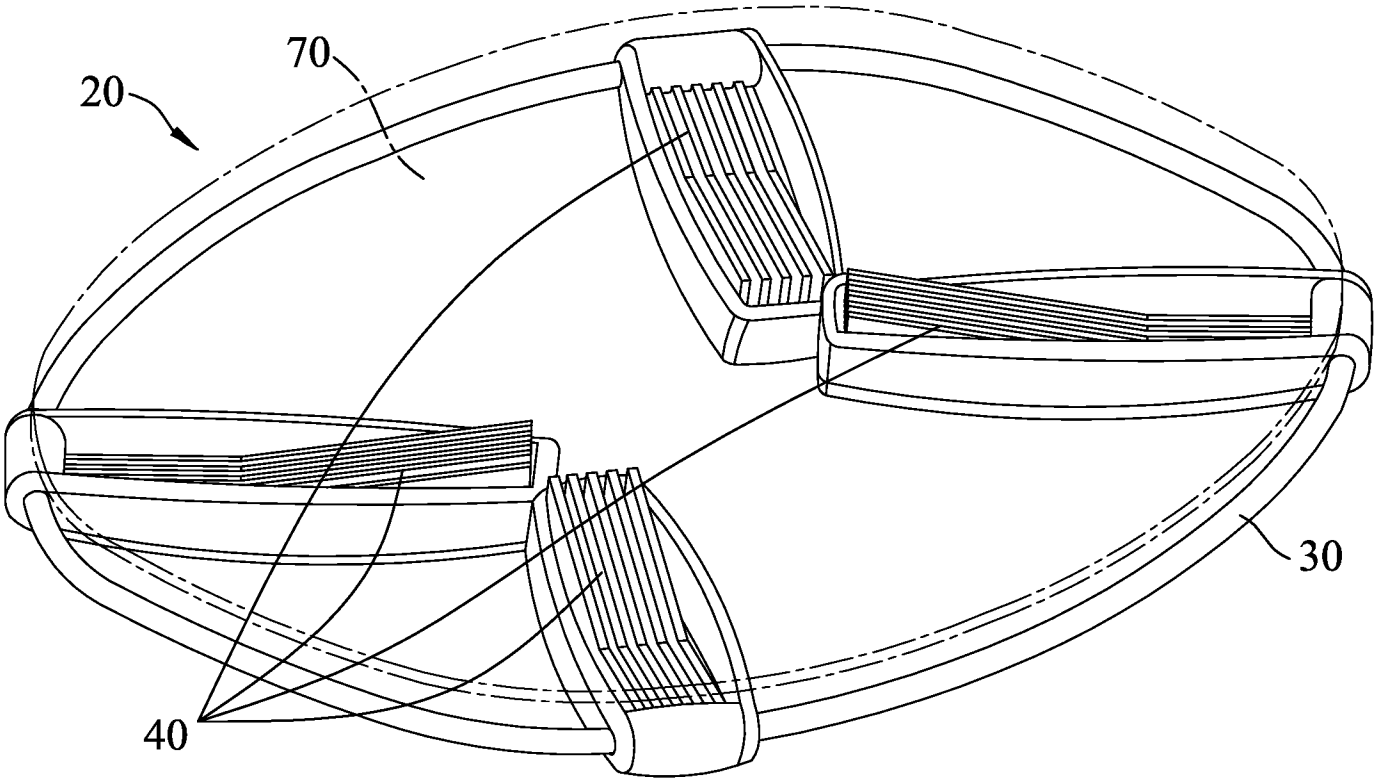
FIG. 14 is a schematic perspective view showing the second embodiment in the collapsed state.
Figure 15:
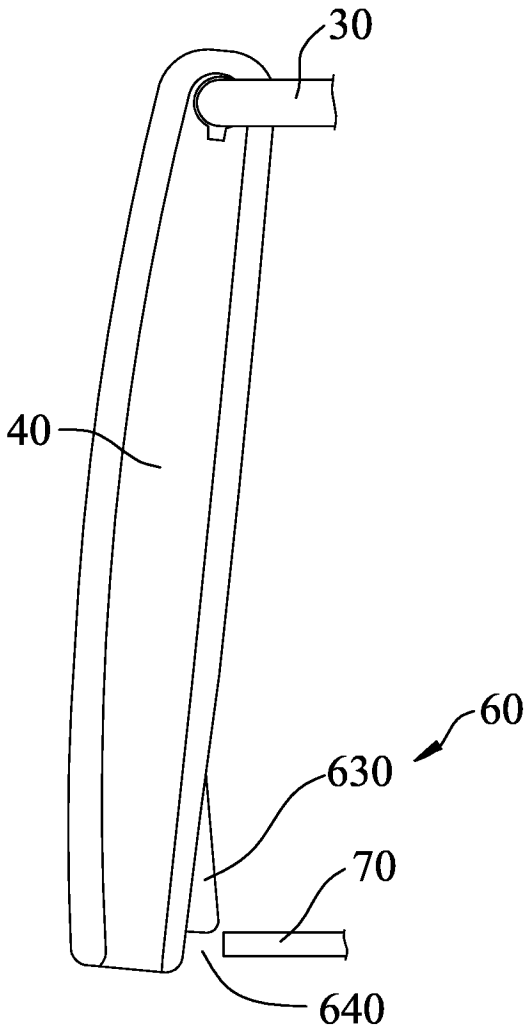
FIG. 15 is a fragmentary side view of the second embodiment.

Referring to FIGS. 13 to 15, a second embodiment of the bassinet 20 according to the present disclosure has a structure similar to that of the first embodiment, with differences described hereinafter.

In the second embodiment, the bassinet 20 includes four of the legs 40 that are pivotally connected to the frame unit 30 and that are disposed angularly spaced apart from each other. The bottom plate 70 is detachably connected among the legs 40 to exert forces pushing the legs 40 away from each other.

When converting the bassinet 20 from the upright state to the collapsed state, the bottom plate 70 is detached from the legs 40, and the legs 40 are pivoted toward each other and folded. Before the legs 40 are folded, the bottom plate 70 may be lifted and slightly tilted to pass through the frame unit 30 from underneath and then placed on the frame unit 30 and the folded four legs 40.

In the second embodiment, the lower limiting mechanism 60 includes four fixtures 630 (only three are shown in FIG. 13) that respectively protrude from the legs 40. Each of the fixtures 630 cooperates with the respective one of the legs 40 to define an engaging space 640 with which the bottom plate 70 is engaged, for connecting the bottom plate 70 to the legs 40. When the bassinet 20 is in the upright state (see FIG. 13), the bottom plate 70 abuts against the legs 40 and the fixtures 630 to push the legs 40 away from each other, thereby creating a robust structure to ensure the structural integrity of the bassinet 20 in the upright state and providing a simplified structure that is easily to disassemble and store. Similar to the first embodiment, the bassinet 20 of the second embodiment can be converted from the upright state (see FIG. 13) to the collapsed state (see FIG. 14) by removing the bottom plate 70, followed by rotating the legs 40 toward each other.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A bassinet adapted to be detachably connected to a playard, said bassinet comprising:

a frame unit;

two legs that are pivotally connected to said frame unit;

a bottom plate that is disposed between said legs, that has a flat plate configuration, and that defines a bottom side of the bassinet; and a lower limiting mechanism that is disposed on at least one of said legs, and that includes a first lower limiting member disposed on one of said legs, and a second lower limiting member disposed on and extending from said bottom plate;

wherein said bottom plate is detachably connected to said legs via said lower limiting mechanism.

2. The bassinet as claimed in claim 1, wherein said second lower limiting member is a protruding block.

3. The bassinet as claimed in claim 2, wherein said first lower limiting member includes a protrusion.

4. The bassinet as claimed in claim 3, wherein said block includes an engagement hole, said protrusion of said first lower limiting member being detachably engaged with said engagement hole.

5. The bassinet as claimed in claim 3, wherein said first lower limiting member further includes a cover door that removably covers said protrusion.

6. The bassinet as claimed in claim 5, wherein said first lower limiting member further includes a spring element that provides said cover door a rotation force toward said bottom plate.

7. The bassinet as claimed in claim 6, wherein each of said legs is a monolithic piece made of one of plastic and metal, and is adapted to be detachably connected to a top rail of the playard.

8. The bassinet as claimed in claim 7, further comprising an upper limiting mechanism that includes two first upper limiting members disposed on said frame unit, and two second upper limiting members respectively disposed on said legs, wherein, when said bottom plate is connected between said legs, said first upper limiting members respectively abut against said second upper limiting members to limit pivotal movement of said legs away from each other.

9. The bassinet as claimed in claim 8, further comprising a bedding that has a first portion at least connected to said frame unit and a second portion opposite to said first portion and connected to said bottom plate, said bedding defining a space adapted for receiving an infant.

10. A bassinet comprising:

a frame unit;

four legs that are pivotally connected to said frame unit and that are disposed angularly spaced apart from each other, each of said legs being made of an elastic material;

an upper limiting mechanism that is disposed on at least one of said frame unit and said legs for limiting pivotal movement of said legs away from each other; and a bottom plate that is detachably connected to said legs to exert forces pushing said legs away from each other;

wherein said bassinet is convertible to a collapsed state, where said bottom plate is detached from said legs and said legs are pivoted toward each other and support said bottom plate.

11. The bassinet as claimed in claim 10, further comprising a lower limiting mechanism including four fixtures that respectively protrude from said legs, each of said fixtures cooperating with the respective one of said legs to define an engaging space with which said bottom plate is engaged, for connecting said bottom plate to said legs.

* * * * *